US005149386A

United States Patent [19]

Smits et al.

[11] Patent Number: 5,149,386

[45] Date of Patent: Sep. 22, 1992

[54] TAMPER-EVIDENT STRUCTURES

[75] Inventors: Paul Smits; Aron M. Rosenfeld, both of Kingston, Canada; Howard F. DeFerrari, Louisville, Ky.

[73] Assignee: Alcan International Limited, Montreal, Canada

[21] Appl. No.: 629,167

[22] Filed: Dec. 17, 1990

Related U.S. Application Data

[60] Continuation of Ser. No. 295,899, Jan. 11, 1989, which is a division of Ser. No. 83,720, Aug. 10, 1987.

[51] Int. Cl.[5] ..... B32B 31/00

[52] U.S. Cl. ..... 156/150; 156/233; 156/308.4; 156/308.6; 427/7; 428/915

[58] Field of Search ..... 156/233, 289, 238, 308.4, 156/308.6, 629, 150; 427/7; 428/40, 41, 42, 43, 915

[56] References Cited

U.S. PATENT DOCUMENTS 4,190,315 2/1980 Brettle et al. ..... 350/96.12

5,015,318 5/1991 Smits et al. ..... 156/233

*Primary Examiner*—David A. Simmons
*Assistant Examiner*—James J. Engel
*Attorney, Agent, or Firm*—Cooper & Dunham

[57] ABSTRACT

The invention relates to a laminated tamper-evident structure which exhibits an irreversible color change upon delamination. The structure includes a laminate of at least two layers capable of generating a color by a light interference and absorption phenomenon that requires direct and intimate contact between an adjacent two of the layers. The strength of attachment among the layers of the laminate is such that the laminate can be uniformly and reliably peeled apart at the interface between the adjacent two layers. An overlying flexible strip of transparent or translucent material is adhered to the laminate to facilitate the peeling operation. Upon peeling apart the laminate, the generated color is irreversibly lost, thus providing evidence that the structure has been tampered with. The structure can be incorporated into a variety of closable articles or products to provide evidence of opening or tampering.

5 Claims, 2 Drawing Sheets

TAMPER-EVIDENT STRUCTURES

This is a continuation of application Ser. No. 295,899, filed Jan. 11, 1989, which is a division of application Ser. No. 07/083,720, filed Aug. 10, 1987.

This invention relates to tamper-evident structures, methods of making such structures, and to closures and other devices incorporating such structures. More particularly, the invention relates to layered tamper-evident structures which exhibit an irreversible colour change when the layers are separated.

There is currently a growing need for tamper-evident structures which undergo some kind of irreversible and readily-observable change when the structures are peeled apart or otherwise disturbed. For example, such structures may be incorporated into the closure devices of containers or packages in such a way that an irreversible visible change is observable when the containers or packages are opened. Alternatively, when identity documents or cards are laminated for security, indicators of the above type may be incorporated into their structures to warn of tampering. Additionally, there is a growing market for "instant win" type lottery tickets which contain a message concealed beneath a peelable or scratchable obscuring layer and it would be advantageous to incorporate tamper indicators into such tickets to prevent unauthorized viewing of the message prior to sale.

Various types of tamper-evident structures which undergo irreversible visual changes are already known. For example, U.S. Pat. No. 4,557,505 issued on Dec. 10, 1985 to Richard M. Schaefer, et al discloses a transparent tape which becomes opaque when subjected to stress, e.g. when peeling or tearing of the tape is attempted, and similar "stress whitening" properties of plastics materials are utilized in the devices of U.S. Pat. No. 4,489,841 issued on Dec. 25, 1984 to Mortimer S. Thompson and U.S. Pat. No. 4,448,317 issued on May 15, 1984 to Mortimer S. Thompson. Another approach to the problem has been the use of microencapsulated dyes which change colour upon exposure to air when the capsules are ruptured (e.g. U.S. Pat. No. 4,519,515 issued on May 28, 1985 to Milton Schonberger; U.S. Pat. No. 4,480,760 issued on Nov. 6, 1984 to Milton Schonberger; and U.S. Pat. No. 4,424,911 issued on Jan. 10, 1984 to Joseph A. Resnick). Additionally, much attention has recently been directed to the use of holograms having a three dimensional visual effect, and iridescent optical multilayer films exhibiting a distinctive colour change with viewing angle, such effects being easily destroyed when the structures are damaged.

The disadvantages of the known devices are that they are either expensive to produce (e.g. the holograms), release contaminating chemicals (e.g. microencapsulated dyes) or can be defeated or replaced if sufficient care is taken (e.g. the stress-whitening plastics).

Accordingly, there is a need for improved tamper-evident structures capable of exhibiting irreversible visible changes.

According to one aspect of the invention, there is provided a tamper-evident structure which comprises: a laminate of at least two layers capable of generating a colour by a light interference and absorption phenomenon that requires direct and intimate contact between at least an adjacent two of said layers, the strength of attachment among the layers of the laminate being such that the laminate can be uniformly and reliably peeled apart at an interface between said two adjacent layers, at least in areas of the laminate where a colour change is desired; and an overlying flexible strip of transparent or translucent material suitable for facilitating the peeling apart of said laminate at said interface, said strip having a strength of attachment to said laminate that is greater than the strength of attachment of said two adjacent layers at said interface; whereby peeling apart of said two adjacent layers at said interface results in loss of said generated colour at least in said desired areas and re-attachment of said layers fails to re-generate said colour in the absence of restoring said direct and intimate contact.

According to another aspect of the invention there is provided a method of making a tamper-evident structure, which comprises: forming a laminate of at least two layers capable of generating a colour by a light interference and absorption phenomenon that requires direct and intimate contact between at least an adjacent two of said layers, said forming step being carried out in such a way that the layers are directly and intimately contacting and adhere together with an adhesive strength which permits said adjacent two layers to be uniformly and reliably peeled apart at an interface between said layers; and adhering an overlying flexible strip of transparent or translucent material over said laminate in such a manner that the strength of attachment of the flexible strip to the laminate exceeds the adhesive strength between said adjacent layers.

Tamper-evident structures of the present invention undergo a substantially irreversible colour change when the two adjacent layers are separated from each other because the direct and intimate contact required for colour generation is difficult or impossible to restore once the adjacent layers have been peeled apart, and the substantially irreversible colour change acts as evidence that the layers have been separated and consequently that the structure has been disturbed. Since the colour change is based on a light interference and absorption phenomenon (as will be explained more fully later), which is a physical rather than a chemical phenomenon, the operability of the structure is substantially unaffected by heat, humidity, aging etc.

The tamper-evident structures of the present invention may consist of as few as two layers (not counting the overlying flexible strip), which shows that the colour generation phenomenon is different from those of other colour-producing structures (e.g. multilayer all-dielectric stacks [minimum 5 layers] or metal/oxide/-metal stacks [minimum 3 layers] etc.). The possibility of providing as few as two layers means that the number of manufacturing steps can be reduced and product costs can be kept low. The latter advantage is extremely important because the acceptability of tamper-evident structures to the packaging industry depends very much upon unit costs to the extent that expensive structures, no matter how effective, are unlikely to find wide acceptance.

A further advantage of the structures of the present invention is that the generated colour is usually both intense and visible without change over a wide range of viewing angles. The structures generate a smooth curve of spectral reflectance rather than narrow bandpasses at specific wavelengths (i.e. a spectral curve exhibiting isolated spike-like features). The practical advantage of this is that the generated colour is easy to see and, conversely, there is no ambiguity about the loss of colour that provides evidence of tampering.

As will be described more fully later, in the present invention, the adhesion between the two active layers is normally deliberately "tuned" in a specific processing step so that delamination may be reliably ensured when desired and avoided during manufacture, handling or storage.

Yet a further advantage is that the structures of the present invention do not generally require the use of highly reflective metal layers and consequently there are no stringent substrate smoothness requirements.

Moreover, the laminated structures of the invention need contain no harmful materials that could contaminate any associated products.

As noted above, in order to be useful as tamper-evident structures, the laminates must be reliably peelable at the desired interface, at least in those areas where a colour change is desired. This means that the adhesion at the interface should preferably be relatively uniform within the aforesaid areas because large and/or irregular variations of the adhesion may result in improper separation, e.g. caused by tearing or splitting of one or other of the layers. Normally the adhesion should be relatively uniform in areas ranging in size from the smallest which can easily be seen by the naked eye up to about one square foot (since tamper evident devices are rarely larger than this). Moreover, when the laminate consists of more than two layers, the adhesion between the layers desired to be separated should be weaker, at least in those areas where a colour change is desired, than the adhesion among the other layers of the laminate. All of these adhesion requirements are relatively easy to achieve in the present invention.

It is contemplated that the structures of the invention may include three basic types, i.e. those which are peelable by hand, those which are peelable by machine and those which are intended to warn against puncturing. Structures which are intended to be peelable by hand should normally have a peel strength in the range of 1–10 lbs per inch width, and those which are peelable by machine should normally have a peel strength of 10–20 lbs per inch width. These values are not absolutely critical, of course, and they depend to some extent on the thickness of the structure to be peeled apart. Moreover, higher or lower peel strengths may be required for special applications or in special circumstances.

In the case of the structure intended to warn against puncturing, the peeling is brought about by the act of puncturing the laminate, e.g. by means of a needle or knife. In these structures, the peel strength should be such that the puncturing tool inevitably peels the laminate apart in the region adjacent to the point of insertion over an area that results in a visible loss of the generated colour. For example, if a needle is used to puncture the laminate, a visible "blister" (i.e. a patch of lost colour) should be formed within the coloured region around the point of insertion.

As will be apparent for reasons given later, laminates which generate a colour by a light interference and absorption phenomenon usually have at least one layer which is extremely thin. As a result, the required peeling of the layers is difficult to achieve and for this reason the laminate is provided with an overlying and adhering strip of transparent or translucent material suitable for facilitating the peeling apart of the laminate. The overlying strip does not contribute to the colour generating properties of the structure. The strip should be flexible and tensionable, i.e. capable of resisting breaking or undue stretching when subjected to tension. Various plastics can be used to form the flexible strip as well as other materials. The strip may include a non-adhering portion adjacent to an edge to form a graspable tab to further facilitate peeling. The strip is usually colourless, but could be coloured, if desired, providing an altered colour to that generated by the laminate. The strip may be attached to the laminate by the use of a transparent adhesive or by means of direct bonding, for example by heating and pressing a thermoplastic strip onto the laminate. Naturally, the adhesion between the strip and the underlying surface of the laminate must be greater than the adhesion between the layers of the laminate intended to be separated, at least in the areas where colour change is desired. The overlying strip should be adhered to the laminate over the entire area to be peeled. In this way, if the layer(s) of laminate being peeled away fracture, split or tear, the separated parts of the layer(s) are tightly held to the overlying strip and the peeling operation proceeds cleanly and reliably.

There are several colour generation phenomena that are dependent on close contact between two or more layers forming a laminate. For example, "interference colours" are generated when light rays re-combine after reflection from two or more surfaces separated from each other by a distance having the order of the wavelength of light. Interference colours of this kind are usually not very intense and are iridescent (i.e. the colour changes with viewing angle) but the colours can be intensified if a large number of thin layers are formed, e.g. as in the known multilayer dielectric stacks which provide five or more non-absorbing dielectric layers to filter and intensify light of a specified wavelength which satisfies the condition of constructive interference. Although such colouration effects are destroyed when the layered structure is disrupted, these structures are difficult and costly to fabricate and hence have limited applicability in tamper-evident devices. Also known are the metal/dielectric/metal multilayer structures comprising at least three layers which constitute a Fabry-Perot reflection type interference filter. These also involve several very thin layers that are readily disrupted, but uniform separation of the layers is difficult to achieve. However, the present inventors have found that distinctive colours can be generated in a basic two layer laminate with the adhesion between the layers "tunable" to allow uniform separation and have found that, in the case of such structures, the colour cannot readily be regenerated by re-laminating the separated layers. Such colours can be made intense by suitable choice of materials and are normally substantially insensitive to viewing angle. Such structures are in addition relatively simple and inexpensive to fabricate, at least in their preferred forms, and are accordingly useful for tamper evident devices of the type under consideration.

The essentially irreversible colour generation phenomenon made use of in the present invention relies on direct and intimate contact between at least two layers. By "intimate" contact we mean that the two layers conform closely with each other at the microscopic level at the interface or indeed structurally merge together in the region of the interface. By "direct ccontact" we mean that there is essentially no other material between the two layers at the interface so that this excludes not only the presence of glues, adhesives and the like, but also the presence of gas molecules from the air which tend to adhere to the layers once they are separated. As noted above, direct and intimate contact is difficult to re-establish once the layers have been separated because mere pressing of the layers together again cannot exclude intervening gas molecules and re-establish suitably close contact (particularly if the surfaces of the layers are moderately rough). Moreover, the use of an adhesive to bond the separated layers together does not result in re-establishment of the colour since it prevents the required direct contact and introduces an optically thick layer that precludes the colour generation phenomenon.

The colour generation phenomenon results from a combination of light interference and light absorption which takes place at the interface between two adjacent layers. The basic form of the invention relies on the fact that certain metals exhibit vivid colours when directly and intimately coated with a thin film (e.g. up to about 1μ thick) of a light transmitting material. In a modification of the basic form of the invention, the combination of a metal layer, a thin film of light transmitting material, a translucent metal layer and a further thin film of light transmitting material is not only capable of generating an intense colour but is also capable of producing a change from one intense colour to a different intense colour when the laminate is peeled apart. Other forms of the invention are possible and, indeed, the invention includes any structure capable of generating a colour by a light interference and absorption phenomenon which relies on direct and intimate contact between adjacent layers and is such that the layers are reliably peelable. Such structures generate intense colours partly because some light absorption takes place at an interface between the layers, and if the layers are separated at this interface, the light absorption effect is difficult to re-establish because it requires direct and intimate contact between the layers.

In the basic form of the invention, the metals which are capable of generating intense colours when covered by a thin film of light-transmitting material include the so-called valve metals such as Ta, Nb, Zr, Hf and Ti, refractory metals such as W, V and Mo, and members of the classes of grey transition metals such as Ni, Fe and Cr, semi-metals such as Bi, and semiconductors such as Si. These are characterized in general by reflectivities over the visible spectrum of 40–60%, preferably 45–55% and more preferably approximately 50%. Metals that in general will not work with highly transparent thin films are good reflectors such as Al, Ag, Au. Although aluminum itself does not generate very intense colours because of its high reflectivity, certain aluminum alloys and mixtures do. Particularly preferred are metals such as Ta, Nb, Ti, Zr, Hf and W which are capable of generating deep colours when the overlying light transmitting layer is composed of the respective native oxide which can be readily formed by a suitable oxidation process. Information about the colours generated by such metals is disclosed in "The Optical Properties of Thin Oxide Films on Tantalum" by A. Charlesby and J. J. Polling, Proc. Royal Society, No. 227 (1955) 434–447, and "Metallurgy of the Rare Metals—6, Tantalum and Niobium" by G. L. Miller, Butterworth Scientific Publications, London, 1959.

The material used to form the thin film overlying the metal layer can be any light transmitting layer having adequate transparency and the thin film can be formed in any suitable way that produces both the required direct and intimate contact and also a level of mutual adhesion that enables the layers to be reliably peeled apart. The material may be organic or inorganic, e.g. a polymeric film, a ceramic glass or a metal oxide, nitride, carbide, fluoride, etc., but thin metal films generally do not work. Various known methods for thin film deposition can effectively be used, e.g. spinning, dipping, spraying, plasma spraying, chemical vapor deposition (CVD), physical vapor deposition (PVD), oxidation (thermal, plasma or chemical anodization), etc. The adhesion between the thin film and the metal layer can be regulated and fine tuned by methods such as processing to induce thermal or intrinsic stresses at the interface, introducing contaminants, impurities, voids or defects at the interface, formation of a weak boundary layer (such as a brittle intermetallic compound by reaction or interdiffusion of the two layers) or employing specific adhesion reducing agents, etc.

In the case of the valve or refractory metals mentioned above, the preferred method of forming the thin film is anodization which results in the formation of a thin film made of an oxide of the metal used to form the metal layer. Ta and Nb are particularly preferred because of the wide range of colours accessible with this technique.

When these valve metals are provided with a conventionally anodized oxide coating, the oxide layer adheres quite tightly to the metal surface and cannot easily be removed, so such systems are not well suited for the desired tamper-evident structures of the present invention. However, it has been found that large areas of the anodized oxide coating can be "adhesion tuned" and made to peel uniformly and in a highly reliable manner from the surface of the colour-generating metal if the anodization is carried out in the presence of an adhesion-reducing agent, preferably a fluorine-containing compound. Solutions of NaF corresponding precisely to solutions used as fluoride oral rinses have been found to be satisfactory (illustrating that harmful chemicals that may contaminate products or production personnel need not be used in the process of the invention).

The adhesion-reducing agent may be coated on the metal surface prior to the start of the anodization treatment or it may be added to the anodization bath. Moreover, it is possible to introduce the adhesion-reducing agent at various stages during the anodization procedure, e.g. by commencing the anodization in a bath containing the adhesion-reducing agent and then transferring the structure to a second bath containing no adhesion-reducing agent for further anodization.

When fluoride is the adhesion-reducing agent, it may be used in the form of an aqueous solution of simple salts, e.g. NaF or KF, or in the form of complex salts, or fluorine containing compounds or in acids such as hydrofluoric acid, fluoroboric acid, etc. The required amount of fluoride can be found by simple trial and experimentation in any particular case, and can be chosen as low as about 0.1% by volume of the bath electrolyte in the case of Ta.

The anodization procedure can be quite conventional apart from the use of the adhesion-reducing agent. Thus, the colour-generating metal film can be connected as an anode in an electrolyte normally used in anodizing, e.g. an organic acid, such as citric acid, oxalic acid and solutions of salts such as ammonium sulphate, ammonium pentaborate, ammonium tartrate and other acids such as boric acid, phosphoric acid, etc. The cathode is preferably a non-reactive metal or carbon.

Anodization is carried out in the standard constant current mode to a selected final forming voltage, the thickness of the oxide layer produced at the anode being determined by the selected voltage. As a result, specific colours can be produced by selecting suitable forming voltages falling within the operable range.

For each valve or refractory metal, the actual colour generated depends on the thickness of the overlying thin film of light-transmitting material up to a maximum thickness of about 1μ and, as noted above, when the thin film is formed by anodization to a set voltage, the thickness of the oxide film depends on the anodization voltage. As an example, the actual colours generated for different thicknesses of tantalum oxide on tantalum are shown in the Table below.

TABLE

| $Ta_2O_5$ Thickness Å | Generated Colour |
|---|---|
| 334 | brown |
| 418 | purple |
| 501 | dark blue |
| 668 | light blue |
| 1303 | yellow |
| 1420 | rust |
| 1553 | dark red |
| 1670 | violet |
| 1754 | aqua blue |
| 1870 | blue-green |
| 2004 | green |

The metal layer itself can either be in the form of a self-supporting plate or foil, or can be a layer adhering to a substrate made of any suitable material. The thickness of the metal layer is not critical except that it should be at least about 250 Å thick otherwise the colour generation effect is not observed. When the valve metal layer is supported on a substrate, the substrate may be made of any material provided it can accept a layer of the metal, does not adversely affect the stability of the laminate or its colour generating effect and, when anodization is used to form the coating layer, does not adversely affect the anodization treatment. These requirements are satisfied by aluminum metal or certain alloys thereof in foil or plate form and, in view of the relatively low price of aluminum, it is therefore a preferred substrate material. Aluminum, when used in the form of a foil, leads to a flexible tamper-indicator which may be an integral part of a package. For economy and convenience, the substrate may also be a plastic film or an article such as part of a container or package. When the metal layer is supported on a substrate it can be formed on the substrate by any suitable technique, e.g. by electroplating, chemical vapour deposition (CVD), or physical vapour deposition (PVD). Examples of PVD are magnetron sputtering, evaporating and ion-plating. Magnetron sputtering techniques are the most desirable in most cases because the resulting layers have good homogeneity and because thin films formed on the resulting metal layers tend to be very uniformly peelable.

A particular advantage of forming the metal layer by deposition on a substrate is that the layer can be made so thin that the original colour cannot be regenerated by any technique once the thin oxide film has been formed and subsequently removed, even if the exposed metal surface is again subjected to anodization. For example, if a tantalum film is deposited on a substrate to a thickness of 1200 Å, a deep green colour is produced when roughly 800 Å of the Ta is converted to 2000 Å of oxide by anodization. This leaves 400 Å of tantalum metal, which is insufficient to re-generate a green colour upon further anodization. Clearly, this is a significant additional safety feature which can defeat even the most sophisticated would-be tamperer.

It was mentioned above that the adhesion-reducing agent may be coated on the metal surface prior to the formation of the thin oxide film. If the adhesion-reducing agent is coated on only limited areas of the metal surface, the thin oxide film subsequently formed on the metal surface is readily peelable only from the sensitized areas, and this makes it possible to form latent patterns or messages in the laminated structure which become visible only when the thin film has been removed from the peelable areas. The patterns or messages then become visible because the unsensitized areas cannot be peeled and retain their generated colour whereas the peeled areas lose their colour irreversibly. The same effect can be produced during anodization by the following alternative technique. That is, limited areas of the valve metal surface may be masked off, e.g. with an adhesive tape, silk screening of a suitable anodizing resist, and the like, and the remaining areas subjected to a preliminary anodization treatment employing an anodization bath containing the adhesion-reducing agent. The masked areas may then be unmasked and the entire surface subjected to anodization in a bath containing no adhesion-reducing agent. As a result, the originally masked areas are non-peelable and the unmasked areas are peelable. Latent messages, logos, intricate patterns etc. can be produced in this way.

For patterns or messages to be truly latent, i.e. invisible prior to peeling, the colour generated by the peelable areas must be virtually identical to the colour generated by the non-peelable areas. This means that the thickness of the coating layer must be very nearly identical in the peelable and non-peelable areas, a condition which is exceedingly difficult to satisfy to the required accuracy by almost all thin film deposition techniques. However, this is not at all difficult to achieve when the anodization treatment is employed, even when a multi-stage anodization process as indicated above is used, because it is found that the final anodization stage automatically produces a coating layer of uniform thickness over the entire surface of the metal.

It is also advantageous to make only limited areas of the laminate peelable for a different reason. In some cases it may be desirable, in order to produce a peel strength predetermined for a particular application, to "tune" the adhesion between the metal layer and the thin film to a finer degree than is possible by adjusting the adhesive strength alone. For example, if the adhesion between the metal layer and the thin film is too weak to survive forming processes or handling, the laminate may be subject to accidental peeling which would reduce the reliability of the resulting tamper evident structure. In these cases, peelable areas may be mixed with non-peelable areas in various patterns (e.g. as stripes or dots) in which case the overall peel strength of the laminate is increased by the adhesion between the overlying flexible strip and the thin film (since the strip has to be pulled away from the thin film in the non-peelable areas). Thus the overall adhesion can be modified either by suitably adjusting the adhesive strength between the overlying strip and the thin film or by suitably varying the peelable to non-peelable area ratio.

A modified form of the invention involves a doubling up of the laminate structure of the basic form. The laminate in the basic form of the invention consists of a metal layer and an overlying thin film. However, this structure may be repeated, e.g. to form a laminate in which there is a first metal layer, a first thin film, a second metal layer and a second thin film. For use in the present invention, the second metal layer should be thin enough to be translucent (but should be at least 250 Å thick for the reason noted above) and the laminate should be peelable at the interface between the second metal layer and the second thin film. Before the laminate is peeled apart, a colour is generated by a mechanism, similar to that produced in the basic form of the invention, taking place between the second metal layer and the second thin film, although there is usually a small loss of intensity due to a small amount of light passing through the second metal layer into the underlying layers. This colour generation is destroyed when the laminate is peeled apart, but the structure remaining after the second thin film has been peeled off is similar, because of the translucent nature of the second metal film, to the structure of the basic form of the invention (again with some minor differences, generally in intensity) and so a second generated colour different from the first may be visible. In this way, peeling of the laminate can cause it to change from one intense colour to a second intense colour, e.g. from green to red. This form of the invention can of course be combined with the form in which certain areas are made peelable while other areas are made non-peelable. In this case, after peeling has been carried out, the remaining structure then has different areas of different colours and a very noticeable effect can be achieved.

In any form of the invention, if the first metal layer is also made so thin as to be translucent, it may be possible to incorporate a hidden message into the structure by a different technique from the one mentioned earlier. For example, a message may be printed on a substrate surface covered by the laminate. When the laminate is intact, the message will be obscured by the generated colour (particularly if the message is printed in ink of the same hue as the generated colour). After peeling, the generated colour will be lost or changed and the printed message will be visible through the overlying translucent metal layer. An example of the message would be "warning, this container has been opened".

Instead of a message, the entire surface of the substrate may be made to have a colour different from the generated colour, thus providing another mechanism for producing a change from one colour to another when peeling takes place.

Presently preferred embodiments of the tamper-evident structures of the invention are described in further detail with reference to the accompanying drawings, in which.

Figure 1:
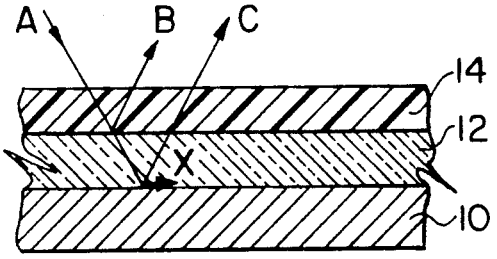
FIG. 1 is a cross-section of a structure according to a basic form of the invention.

First of all, it should be understood that the relative thicknesses of the various layers shown in the drawings are not to scale.

FIG. 1 shows a structure according to a basic form of the invention. It consists of a layer 10 preferably of a valve or refractory metal (or a material having similar optical properties), a thin film 12 of a light transmitting material in direct and intimate contact with the layer 10 and an overlying strip 14 of flexible tensionable translucent or transparent material, e.g. polyethylene. White light incident on the structure, indicated by ray A, is partially reflected by the upper surface of the thin film 12 (ray B) and is partially transmitted to be reflected (ray C) by the upper surface of the layer 10.

The interference colours generated when rays B and C combine will be weak if the relative intensities of rays B and C differ significantly, but will be intense and relatively monochromatic if the intensities are similar. When highly reflective metals are used for the layer 10, most of the light is reflected at the upper surface of the metal layer and so ray C is much more intense than ray B. In the case of those materials mentioned above which are suitable for the invention, however, light absorption (indicated by arrow X) takes place at the interface between thin film 12 and the layer 10. This absorption reduces the intensity of ray C and makes the intensities of rays B and C more comparable so that an intense colour is generated. The light absorption depends on direct and intimate contact between layer 10 and film 12 and separation of these layers causes the intense colour to be lost, leaving the grey colour of the material 10. Once the layers have been separated, the intense colour cannot be regenerated by repositioning film 12 on layer 10, even if the layers are pressed together, because the contact will no longer be direct (gas molecules intervene) and/or intimate (the surfaces will no longer conform closely at the microscopic level). For the structure to be useful in the invention, the laminate should be reliably peelable at the interface between thin film 12 and layer 10 and the adhesion of the overlying strip 14 to the thin film 12 should be greater than the adhesion between the film 12 to the layer 10.

Figure 2:
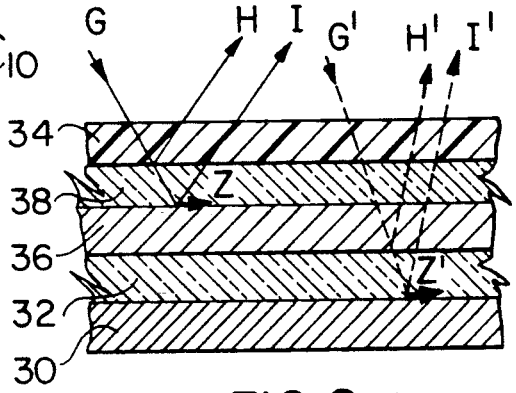
FIG. 2 is a cross-section of a structure according to a modified preferred form of the invention.

FIG. 2 shows a structure according to a modified form of the invention. The structure consists of a first layer 30 of a valve or refractory metal (or a material having similar optical properties), a thin film of light transmitting material 32, a second metal or similar material layer 36 (thin enough to be translucent), a third thin film 38 of light transmitting material and an overlying strip 34. When the structure is intact and the layers are in direct and intimate contact, incident white light (ray G) is partially reflected from the upper surface of film 38 (ray H) and partially transmitted and then reflected from the upper surface of layer 36 (ray I). The structure made up of layers 36, 38, 34 resembles the basic form of the invention shown in FIG. 1 and an intense colour is generated by virtue of the absorption (arrow Z) at the interface between layers 36 and 38. The structure is made reliably peelable at this interface so that the intense colour originally generated is lost when the laminate is peeled apart. The remaining structure (layers 30, 32, 36) then forms a second colour-generating laminate and incident white light (ray G') is partially reflected at the interface between layers 32 and 36 (ray H'), partially transmitted by layer 32, partially reflected (ray I') at the upper surface of layer 30 and partially absorbed at the interface between layers 30 an 32 (arrow Z'). Consequently, when the original laminate is peeled apart, a second intense colour is generated which may be different from the intense colour generated by the intact structure. Therefore, peeling of the laminate at the interface between layers 36 and 38 results in a change from one intense colour to a second, which is an effective indication of tampering.

Figure 3:
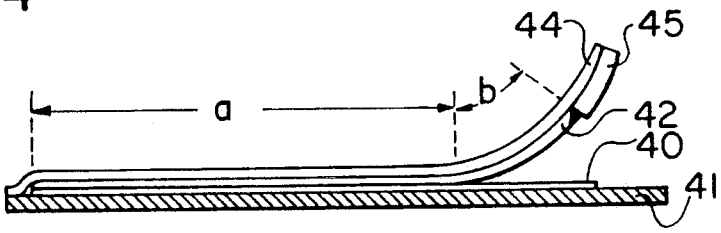
FIG. 3 is a cross-section of a preferred embodiment according to the basic form of the invention.

FIG. 3 is a cross-section of a second embodiment of a tamper-evident structure according to the basic form of the invention. It consists of a flat substrate 41, preferably made of aluminum foil, a layer 40 of a valve or refractory metal, preferably tantalum, produced by vacuum sputtering, a thin film 42 of a light transmitting material, preferably an anodically-formed $Ta_2O_5$ layer, and an overlying strip 44, preferably made of a transparent plastic. One end of the strip has an underlying anti-adhesion strip 45 to form a non-adhering tab which may be easily gripped between finger and thumb to facilitate the peeling procedure.

When the strip 44 is pulled away from the substrate 41 in the manner shown at the right hand side of FIG. 3, the adhesion between the strip 44 and the underlying thin film 42 causes the latter to be peeled away from the colour-generating metal layer 40 because the adhesion between these two layers is less than the adhesion between the thin film and the adhering strip. In the region b where the layers are separated, the thin film 42 and the colour-generating metal layer 40 take on their normal colours, i.e. the thin film 42 is colourless and the layer 40 has a metallic gray colour. In the region a where the layers 40, 42 are in direct and intimate contact, a deep generated colour is visible through the strip 44. As the region b increases in area and the region a reduces in area, the area of visible colour shrinks and is eliminated when the layers 40 and 42 are completely separated.

Once the layer 40 and thin film 42 have been separated, attempts to re-laminate them fail to re-generate the original colour and the layers retain their natural appearances. No amount of pressing or adhering of the layers results in regeneration of the original colour. Consequently, the irreversible loss of the original colour provides reliable evidence of separation of the layer 40 and thin film 42 and this feature can be used to indicate unauthorized tampering with or prior use of the tamper-evident structure.

Figure 4:
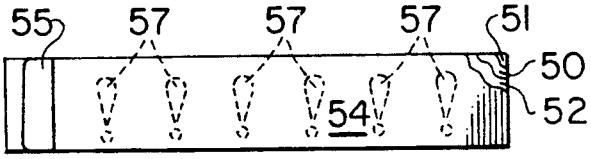
FIG. 4 is a plan view of a second embodiment of the basic form.

FIG. 4 shows an example of an anti-tampering device which makes use of a tamper-evident structure similar to that shown in FIG. 3. In this embodiment, the thin film 52, similar to film 42 of FIG. 3, is peelable from a colour generating metal layer 50 formed on a substrate 51 but only in certain areas. The remaining non-peelable areas are in the shapes of exclamation points 57. The peelable and non-peelable areas are formed in the laminate by the selective use of an adhesion-reducing agent as mentioned previously. A plastic strip 54 has a non-adhering graspable tab 55 at one end and can thus be peeled away from the substrate 51, causing the thin film 52 and the metal layer 50 to separate in those areas where the coating layer is peelable. In the regions of the exclamation points 57, the thin film remains intimately attached to the metal layer and the plastic strip pulls away from the thin film 52.

Prior to peeling, the entire surface visible through the plastic strip 54 exhibits a deep generated colour. After peeling, the colour disappears except in the regions of the exclamation points 57 whose shapes become visible because of their colour contrast with the colourless (grey) background. The exclamation points (or other message or pattern formed in the same way) provide a warning that the layers have been separated in those cases where the general colour loss achieved in the embodiment of FIG. 3 is not, in itself, considered adequate warning (or when a logo is to be revealed).

Figure 5:
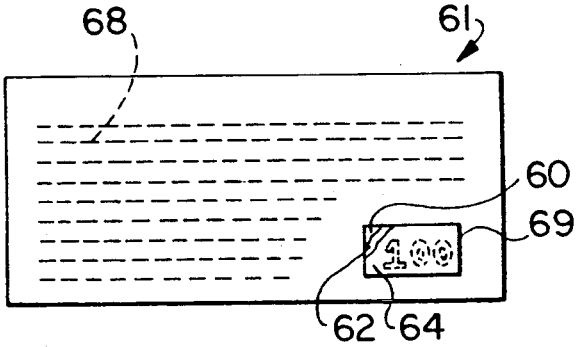
FIG. 5 is a plan view of a lottery ticket incorporating an embodiment of the invention with various layers shown partially cut away.

FIG. 5 shows a particular use for a tamper-evident structure of the present invention. A lottery or similar ticket 61 is provided with normal printing 68 and with a box 69 comprising a laminated structure having a metal layer 60, a thin film 62 and an overlying plastic strip 64. In this embodiment, the substrate, equivalent to the layer 41 of FIG. 3, may be the ticket 61 or an intervening foil layer.

The box 69 contains a latent message, e.g. the number "100" as shown, formed by making the areas of the message non-peelable and the remaining areas peelable, in the manner indicated previously.

Prior to sale of the ticket, the box 69 has a deep generated colour resulting from the intimate contact of the layer 60 and the thin film 62, and the latent message is invisible because the area of the latent message is the same colour as the remaining area of the box 69. Upon purchase, the purchasor peels off the plastic strip 64 or scratches it away, e.g. with a coin, a knife or an eraser. The thin film 62 easily peels away from or flakes off the metal layer 60 in the non-message areas, but remains in place in the message areas. In consequence, the message becomes visible as coloured areas against a non-coloured background. Once the message has been viewed, the box cannot be returned to its original condition because, even if the removed parts of the thin film are replaced, the original colour cannot be regenerated in the separated areas.

It would of course be possible to make the areas of the message peelable and the remaining areas non-peelable, rather than vice versa as described above. The message would then appear as colourless shapes against a coloured background.

Figure 6:
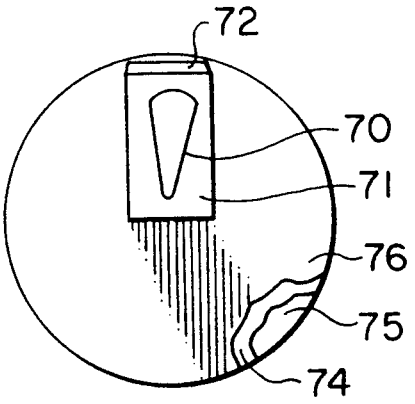
FIG. 6 is a plan view of a beverage can incorporating an embodiment of the invention with various layers shown partially cut away.

FIG. 6 is a plan view of the top of a beverage can. The top has a pour opening 70 located beneath a transparent sealing strip 71. The strip 71 has a graspable tab 72 at one end which is not adhered to the can. When the can is to be opened, the tab 72 is grasped and the strip is peeled away from the top to expose the pour opening 70.

The whole of the top of the can is provided with a layer 74 of a valve metal (e.g. tantalum) magnetron sputtered or otherwise formed on the surface 75 of the material (e.g. aluminum) used to form the can. The surface of the valve metal in turn has a thin film 76 of $Ta_2O_5$ formed anodically. The thickness of the thin film is such that an intense colour, e.g. green, is generated at the can surface over the whole of the top. The sealing strip 71 is adhered to the $Ta_2O_5$ film around the edges of the pour opening 70 and the adhesion between the thin film 76 and the Ta metal layer 74 is such that these layers are peeled apart when the sealing strip 71 is peeled from the can. Consequently, the area from which the strip 71 has been peeled loses the generated colour and takes on the grey colour of the Ta metal. This colour change shows that the can has been opened and that the can should not be purchased if the colour change is apparent prior to sale.

Figure 7:
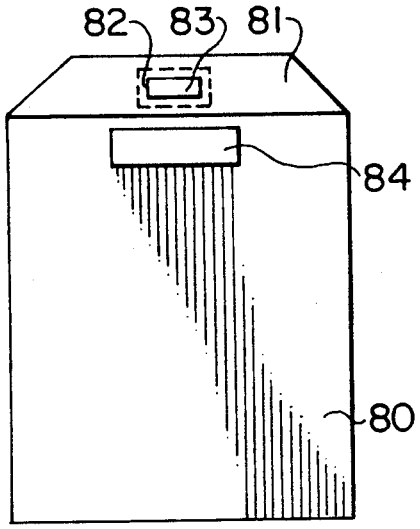
FIG. 7 is a rear elevational view of an envelope incorporating an embodiment of the invention.

FIG. 7 shows an envelope having a body 80 and a flap 81. The envelope has a rectangular window 82 covered by a transparent layer 83 which has a layer of adhesive on the side which contacts the envelope body 80 when the flap is bent over. The adhesive on the layer 83 can form part of a strip of adhesive (not shown) on the inside of the flap used for sealing the flap to the envelope body. The envelope body 80, in the region where it is contacted with the flap 81, has a tamper-evident laminate 84 strongly adhered to the fabric of the envelope. For example, the laminate may consist of an aluminum foil substrate bearing a sputtered Ta layer and an anodized $Ta_2O_5$ oxide layer. When the flap 81 is closed, the colour generated by the laminate 84 is visible through the transparent layer 83 in the rectangular window 82. The adhesive on the transparent layer causes it to adhere tightly to the laminate 84. If opening of the envelope is carried out, the transparent layer causes the laminate 84 to be peeled apart so that the generated colour is lost. Re-sealing of the flap does not result in restoration of the generated colour. To protect the adhesive on the transparent layer 83, the inside of the window 82 may be covered by a loosely adhering backing strip (not shown) which would be removed prior to use of the envelope. A similar backing strip could be provided over the laminate 84 provided it adhered weakly enough not to cause peeling of the laminate when removed, or provided it adhered only to the periphery of the laminate or the surrounding envelope body.

Figure 8:
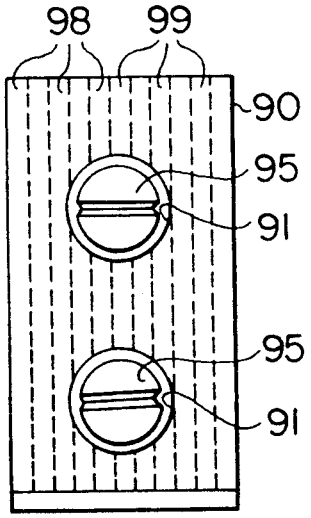
FIG. 8 is a rear elevational view, on an enlarged scale, of a tablet package incorporating an embodiment of the invention.
Figure 9:
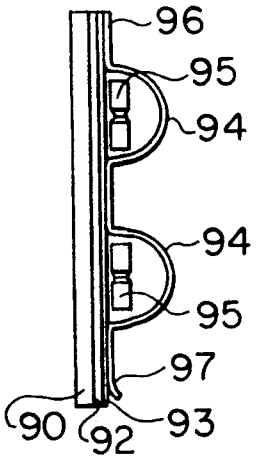
FIG. 9 is a side elevational view of the package of FIG. 8.

FIG. 8 is a front elevational view of a blister pack for tablets and FIG. 9 is a side elevational view of the same pack. The pack consists of a rectangle 90, made of stiff A1 foil or A1 foil laminated to cardboard, provided with holes 91.

The front surface of the A1 rectangle 90 is provided with a sputtered layer of Ta 92 and an anodized thin film of $Ta_2O_5$ 93. This structure generates an intense colour. Compartments 94 for tablets 95 are formed by adhering (e.g. by adhesively or thermally) a plastic bubble sheet 96 to the $Ta_2O_5$ film. One edge of the bubble strip is not adhered in this way in order to form a graspable tab 97. The package is opened by pulling the plastic bubble strip 96 away from the foil rectangle 90. When this is done, the parts of the bubble strip adhering to the $Ta_2O_5$ film peel the oxide film away from the Ta layer so that the generated colour is irreversibly lost, providing evidence that the package has been opened.

Desirably, the $Ta_2O_5$ film is applied to the Ta layer in such a way that areas in the form of stripes 98 adhere more weakly to the Ta layer than adjacent areas in the form of interleaved stripes 99. When the bubble strip 96 is peeled off, the oxide film in the stripes 98 is removed with it in, whereas the oxide film in the stripes 99 remains attached to the Ta layer and instead the bubble layer 96 is peeled away from the oxide film. The generated colour is then lost only in the areas of stripes 98 so a striped pattern of coloured lines separated by colourless (grey) lines is produced to warn of tampering. The overall peel strength of the bubble strip 96 is consequently affected both by the strength of adhesion between the bubble strip and the oxide film in the stripes 99, and the strength of adhesion of the oxide film to the Ta layer in the stripes 98.

Prior to peeling the stripes 98 and 99 have the same appearance since the generated colour is the same, and so the strips are indicated in dotted lines in FIG. 9.

As well as being incorporated into the closure devices of containers or packages, the structures may be sold as they are, e.g. in tape or plate form, for a variety of security purposes.

The invention is further illustrated by the following Examples.

EXAMPLE 1

A layer of Ta 3500 Å thick was sputtered onto standard 75 μ thick Al container foil in a commercial planar magnetron sputtering apparatus. Sputtering was carried out in the dc magnetron mode at a power density of 10 watt /cm$^2$ and in argon atmosphere at a pressure of 10 mtorr. The coated foil was subsequently anodized in an aqueous solution of 50 g/l of citric acid doped with concentrated hydrofluoric acid to 0.1% by volume. Anodization was carried out at a constant current density of 1 mA/cm$^2$ to a forming voltage of 105 V and then additionally at constant voltage for a period of three minutes over which the current decayed. This procedure generates a deep blue colour corresponding to 1754 Å of Ta oxide with a residual underlying metal thickness of 2817 Å.

A transparent plastic sheet coated on one side with a medium strength adhesive (3M Scotch Brand #822 Tape Pad) was then manually laminated with a roller to the anodized foil, with a non-sticking tab inserted along one edge to facilitate peeling.

The resulting foil/plastic laminate could then be readily peeled manually. The "coloured" oxide stripped smoothly and evenly, adhering uniformly to the separated plastic film and became transparent after peeling. The Ta remaining on the foil assumed its normal metallic lustre. Pressing the plastic bath onto the foil did not restore the previous colouration.

EXAMPLE 2

A layer of tantalum 3500 Å thick was sputter coated onto standard commercial purity household aluminum foil. Sputtering was carried out through a mask to form a checkerboard pattern of alternating Al and Ta squares. Anodizing was subsequently carried out to a forming voltages of 112 V to develop a deep blue-green colouration on the Ta squares. This yielded 1870 Å of $Ta_2O_5$ and a residual Ta metal thickness of 2770 Å. The anodizing electrolyte was the standard citric acid bath used in Example 1 but doped with a small percentage by volume of concentrated hydrofluoric acid (one drop in 500 ml).

The aluminum foil thus coated was then placed together with an overlying 57.5 μm thick, standard heat sealable, low density polyethylene film, in a bench-top hot press and pressed at 150° C. with a pressure of 100 psi for three seconds.

The resulting foil/plastic laminate could be peeled manually. The 'coloured' oxide on the Ta squares peeled smoothly and evenly, adhering uniformly to the separated plastic and became transparent after peeling. The remaining Ta on the foil assumed its normal metallic lustre. Pressing the plastic back onto the foil did not restore the previous colouration of the Ta areas.

The peel strength of the structure of this Example was greater than that of Example 1 because the plastic laminate adhered quite strongly to the Al squares and this increased the average peel strength of the structure.

EXAMPLE 3

Ta coated foil was prepared as in Example 1. An anodization mask comprised of a pad of adhesive tape (3M Scotch brand electrical tape) from which an array of stripes 0.5 cm wide and separated by 0.5 cm had been cut out, was pressed onto the coated foil. Anodization was carried out as in Example 1 in the HF doped electrolyte to a forming voltage of 70 V. The foil was then removed from the anodizing bath and the stripe array mask peeled off. The foil was subsequently anodized uniformly over both the previously masked and exposed areas to a forming voltage of 105 V as in Example 1 but in an un-doped citric acid solution. A transparent adhesive sheet was then laminated to the foil as in Example 1. The final sample appeared uniformly blue, apparently identical to that prepared in Example 1, with no vestige of stripe demarcation.

On peeling the overlying plastic as above, the oxide separated and adhered to the tape only in the stripe areas previously exposed to the first anodizing step, while in the remaining areas, the tape separated uniformly from the oxide which remained adhered to the underlying Ta metal. Peeling thus exposed an array of normal metallic Ta stripes against a blue background.

EXAMPLE 4

Ta coated foil was prepared as in Example 1 and anodized according to Example 1 in pure citric acid to a forming voltage of 93 V to generate a deep red colour. The anodized foil was then dried and sputtered again as described in Example 1 to a thickness of 933 Å of Ta. The re-sputtered foil was then re-anodized, this time in HF doped electrolyte, to a forming voltage of 105 V. This yielded a thickness of the second oxide of 1754 Å on a residual metal layer of thickness 250 Å, which thickness for Ta is semi-transparent. The sample had a uniformly blue colour slightly different from that obtained in Example 1 without the underlying metal/oxide structure. The anodized foil was then laminated with a plastic film as in Example 1. On peeling the foil/-plastic laminate apart, separation occurred at the second metal/oxide interface, the blue colour disappeared exposing the red colour of the underlying structure intact on the foil.

EXAMPLE 5

A foil/plastic laminate as described in Example 1 was prepared with Nb replacing Ta and sputtered to a thickness of 4000 Å under the conditions of Example 1. Anodization was carried out according to the same procedure as in Example 1, but in an electrolyte consisting of 0.2% aqueous solution by weight of sodium fluoride, to a forming voltage of 50 V. This generated an intense yellow colour corresponding to approximately 1125 Å of Nb oxide with 3430 Å of Nb metal underlying. The resulting laminate could be peeled as in Example 1 with colour loss and no colour restoration on pressing back.

EXAMPLE 6

Ta coated foil was prepared as in Example 1. A mask consisting of a silk screen with a square array pattern of company logos, each approximately 1 cm wide, and separated by approximately 1 cm, was prepared according to techniques well known in the graphic arts. The screen formed a negative image with the logos open and the surrounding area stopped off. The screen was then pressed onto the Ta coated foil and acid resistant ink was rolled onto the foil through the open areas consisting of the logo array. The screen was then removed leaving an array of logos on the foil as a positive image. Anodization was carried out as in Example 1 in the HF-doped electrolyte to a forming voltage of 70 V. The foil was then removed from the anodizing bath and the inked patterns, which had acted as an anodizing resist, were stripped in Xylol solvent. The foil was subsequently re-anodized uniformly over both the previously masked and exposed areas to a forming voltage of 105 V as in Example 1 but in an un-doped citric acid solution. A transparent adhesive sheet was then laminated to the foil as in Example 1. The final sample appeared uniformly blue, apparently identical to that prepared in Example 1.

On peeling the overlying plastic as above, the oxide separated and adhered to the tape only in the background areas previously exposed to the first anodizing step. In the masked and then anodized logo areas the oxide remained adhered to the underlying Ta metal. Peeling thus revealed an array of blue logos against a grey, metallic background.

We claim:

1. A method of making a tamper-evident structure incorporating latent patterns or messages which become visible only upon activation of said structure, which method comprises:

forming a laminate capable of generating a substantially non-dichroic colour by a light interference and absorption phenomenon, consisting of a layer of an anodizable metal of medium light reflectivity and a layer of a metal oxide, by coating limited areas of said metal layer with an adherent mask, thus creating masked areas and unmasked areas on said metal layer, subjecting said masked metal layer to anodization to produce an initial layer of metal oxide on said unmasked areas, said anodization being carried out in the presence of sufficient fluorine ions to make said layer of metal oxide adherent to but detachable from said metal in said unmasked areas, removing said mask, and carrying out further anodization of said metal layer in the absence of fluorine ions in order to form said layer of metal oxide of said laminate over an entire surface of said metal layer; and adhering a flexible strip of transparent or translucent material over said laminate in such a manner that the strength of attachment of the flexible strip to the laminate exceeds the adhesive strength between said layers of metal and metal oxide in said unmasked areas.

2. A method according to claim 1 wherein said layer of a metal of medium light reflectivity is formed by sputtering a film of said metal onto a substrate.

3. A method according to claim 1 wherein a ratio of said masked areas and said unmasked areas is chosen, together with an adhesive strength of an adhesive used to attach said flexible transparent or translucent strip to said laminate, to achieve a predetermined peel strength when said flexible strip is peeled from said laminate.

4. A method according to claim 1 wherein said sputtering is carried out in such a way that said layer of metal has a predetermined thickness, said predetermined thickness being such that said layer can be anodized to produce an oxide film capable of generating a predetermined color while leaving insufficient metal unconsumed after said anodization to permit reanodization, after detachment of said oxide film, to form a subsequent oxide film capable of generating said predetermined color.

5. A method according to claim 1 wherein an electrolyte employed for said anodization for producing said initial oxide film contains said fluorine ions derived from a fluoride solution forming at least 0.1% by volume of the electrolyte.

* * * * *